US008884903B2

(12) United States Patent
Girault

(10) Patent No.: US 8,884,903 B2
(45) Date of Patent: Nov. 11, 2014

(54) REMOTE CONTROLLER FOR MULTIPLE NAVIGATION DEVICES

(75) Inventor: Florian Girault, Amagasaki (JP)

(73) Assignee: Furuno Electric Co., Ltd., Nishinomiya (JP)

( * ) Notice: Subject to any disclaimer, the term of this patent is extended or adjusted under 35 U.S.C. 154(b) by 177 days.

(21) Appl. No.: 13/609,111

(22) Filed: Sep. 10, 2012

(65) Prior Publication Data

US 2014/0071059 A1 Mar. 13, 2014

(51) Int. Cl.
*G06F 3/041* (2006.01)
*G09G 5/00* (2006.01)

(52) U.S. Cl.
USPC ..... 345/173; 345/212

(58) Field of Classification Search
CPC ..... H04N 5/44; G09G 5/00; H04L 17/02; G06F 3/0488; G06F 3/0482; G06F 3/04886; G06F 1/16; G06F 15/16
See application file for complete search history.

(56) References Cited

U.S. PATENT DOCUMENTS

| | | | | |
|---|---|---|---|---|
| 6,107,997 | A | 8/2000 | Ure | |
| 6,633,281 | B2 | 10/2003 | Lin et al. | |
| 6,909,946 | B1 | 6/2005 | Kabel et al. | |
| 7,215,279 | B1 | 5/2007 | Poindexter et al. | |
| 7,797,417 | B2 | 9/2010 | Choi | |
| 2006/0034042 | A1 | 2/2006 | Hisano et al. | |
| 2007/0013662 | A1 | 1/2007 | Fauth | |
| 2007/0080845 | A1 | 4/2007 | Amand | |
| 2010/0109999 | A1 | 5/2010 | Qui | |
| 2010/0201891 | A1 * | 8/2010 | Laroia et al. | 348/734 |
| 2011/0191516 | A1 * | 8/2011 | Xiong et al. | 710/305 |

FOREIGN PATENT DOCUMENTS

| | | | |
|---|---|---|---|
| JP | 7123479 | A | 5/1995 |
| JP | 10271573 | A | 10/1998 |
| JP | 3473731 | B2 | 12/2003 |

* cited by examiner

*Primary Examiner* — Michael Faragalla
(74) *Attorney, Agent, or Firm* — Alleman Hall McCoy Russell & Tuttle LLP

(57) ABSTRACT

Embodiments related to controlling one or more controllable marine electronics devices are provided. One example embodiment provides a remote control device comprising a touch-sensitive display. The remote control device is configured to receive device information from each of the one or more controllable marine electronics devices via the computer network, and display a selection graphical user interface (GUI) including a plurality of graphical selectors each associated with a respective one of the controllable marine electronics devices. The remote control device is further configured to display a remote control user interface for a target controllable marine electronics device corresponding to a selected graphical selector on the touch sensitive display.

20 Claims, 6 Drawing Sheets

REMOTE CONTROLLER FOR MULTIPLE NAVIGATION DEVICES

BACKGROUND

Modern watercraft utilize a variety of marine electronics devices, such as navigation equipment, depth finders, etc. Some of these devices feature electronic displays and native user interfaces, while others operate as sensors and provide information to other on-board equipment without having a dedicated display or native user interface. With the proliferation of such devices, the variety and accuracy of information available to a vessel operator has been greatly improved. However, one drawback of using multiple marine electronics devices is that each device presents a different user interface to the vessel operator. As a result, it can be challenging for the operator to quickly find and understand the information presented by each marine electronics device and enter appropriate user commands. Piloting the vessel may therefore be unnecessarily burdensome.

SUMMARY

Embodiments related to controlling one or more controllable marine electronics devices are provided. One example embodiment provides a remote control device comprising a touch-sensitive display configured to display graphical images, and to receive touch input from a user; and a communication subsystem configured to provide bidirectional communication with one or more controllable marine electronics devices via a computer network. The remote control device further comprises processing hardware and persistent memory including instructions executable by the processing hardware to cause the processing hardware to receive device information from each of the one or more controllable marine electronics devices via the computer network and to, upon receiving the device information, receive control information for controlling each of the one or more controllable marine electronics devices via the computer network. The instructions are yet further executable to: display a selection graphical user interface (GUI) on the touch-sensitive display, the selection GUI including a plurality of graphical selectors, each graphical selector being associated with a respective one of the controllable marine electronics devices; and, upon receiving touch input associated with a selected graphical selector, display a remote control user interface for a target controllable marine electronics device corresponding to the selected graphical selector on the touch sensitive display.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Typical marine electronics devices (e.g., radar, sonar, GPS, fish finders, depth finders, Electronic Chart Display and Information Systems "ECDIS", and the like) include, and/or are operatively coupled to, one or more human-machine interfaces. Such interfaces may include one or more input mechanisms (e.g., buttons, touch-input mechanisms, rotational knobs, etc.) and/or one or more output mechanisms (e.g., LCD displays providing a native graphical user interface ("GUI"), LED indicators, etc.). In some embodiments, such interfaces may be provided via one or more devices positioned at a location, such as near the operator, which is displaced from one or more communicatively-coupled sensors (e.g., RADAR antennas, SONAR transducers, etc.), whereas other marine electronics devices may include the interface mechanism(s) and the sensor(s) within a shared housing (e.g., stand-alone GPS devices). Regardless of the specific configuration, such marine electronics devices may be configured to provide a "native" user interface ("UI") (e.g., graphical and/or non-graphical user interface) via such mechanisms. As used herein, the term "marine electronics devices" refers to electronic devices that are configured to be operated in a marine environment, such as aboard a watercraft, and is meant to encompass, e.g., radar, sonar, GPS, fish finders, depth finders, chart plotter, ECDIS, and the like.

Users of such devices may therefore be expected to learn, and thus memorize, operation(s) specific to the respective interface(s), which may result in an unsuitable and/or overly complicated user experience during typical use case scenarios (e.g., during use/control of a watercraft). Furthermore, as each device may include one or more of the above-mentioned input mechanisms, such devices may necessitate positioning near the user, thereby increasing space used and potentially further compromising the user experience. It will therefore be appreciated that it may be desirable to provide a remote control device configured to provide a universal user interface such that each of the multiple marine electronics devices may be controlled via a single remote control device.

Figure 1:
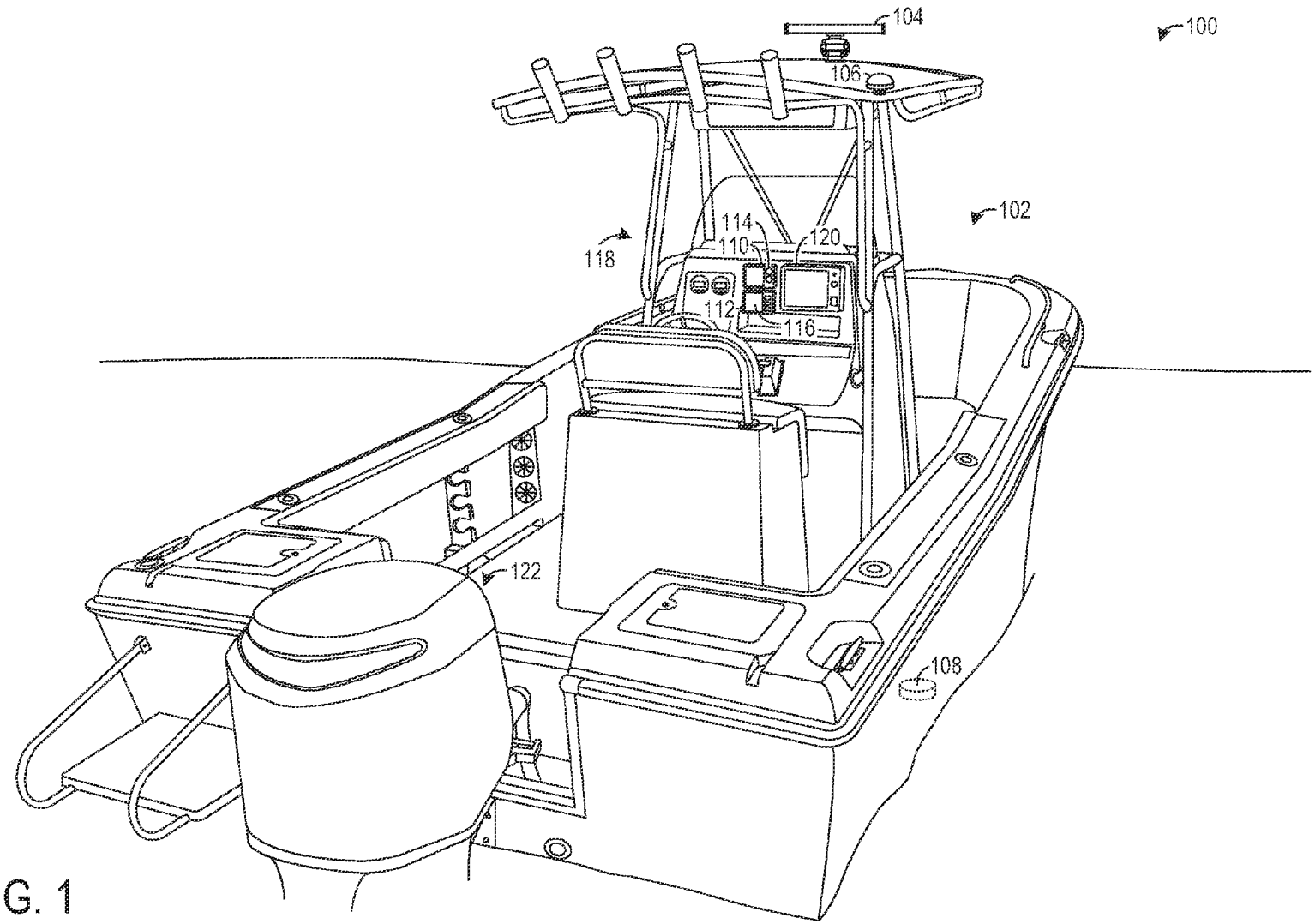
FIG. 1 shows an example use case scenario comprising a non-limiting example of remote control device.

For example, turning to FIG. 1, a typical use environment 100 comprising vessel 102 is illustrated. Vessel 102 comprises a plurality of marine electronics devices 104 (e.g., RADAR antenna), 106 (e.g., GPS receiver), and 108 (e.g., fish finder transducer) coupled thereto. As mentioned above, such devices may be disposed away from the user(s) due to various considerations. For example, typical fish finder transducers (e.g., transducer 108) are configured to be disposed near, and/or through, an external surface of a watercraft (e.g., vessel 102) in order to provide suitable depth information.

With this in mind, vessel 102 is further illustrated as comprising marine electronics devices 110 and 112 including one or more input mechanisms 114 (e.g., rotational knobs, buttons, etc.) and/or one or more output mechanisms 116 (e.g., LCD displays) as to provide a native graphical user interface. Devices 110 and 112 may be configured to communicate with one or more of devices 104, 106, and 108, for example to provide graphical representation of output from radar 104, and/or may provide one or more "stand-alone" functionalities.

It will be appreciated from the illustrated scenario of FIG. 1 that devices 110 and 112 may utilize an unsuitable amount of space within the space available for such devices on vessel 102 (e.g., on, in, or around center console 118) and/or may be otherwise undesirable. Accordingly, FIG. 1 further includes remote control device 120 configured to communicate with one or more of marine electronics devices 104, 106, 108, 110, and 112. For example, such devices may be configured to communicate via one or more wired and/or wireless connections according to one or more protocols (e.g., HTTP, NMEA 2000, device-specific and/or manufacturer-specific protocol(s), etc.). It will be appreciated that these examples are intended to be non-limiting, and that remote control device 120 may be configured to interface with (e.g., receive information from and/or provide information to) any one or more marine electronics devices via any suitable mechanism, or combination of mechanisms, without departing from the scope of the present disclosure. For example, remote control device may be configured to monitor and/or modify one or more parameters of engine 122.

Figure 2:
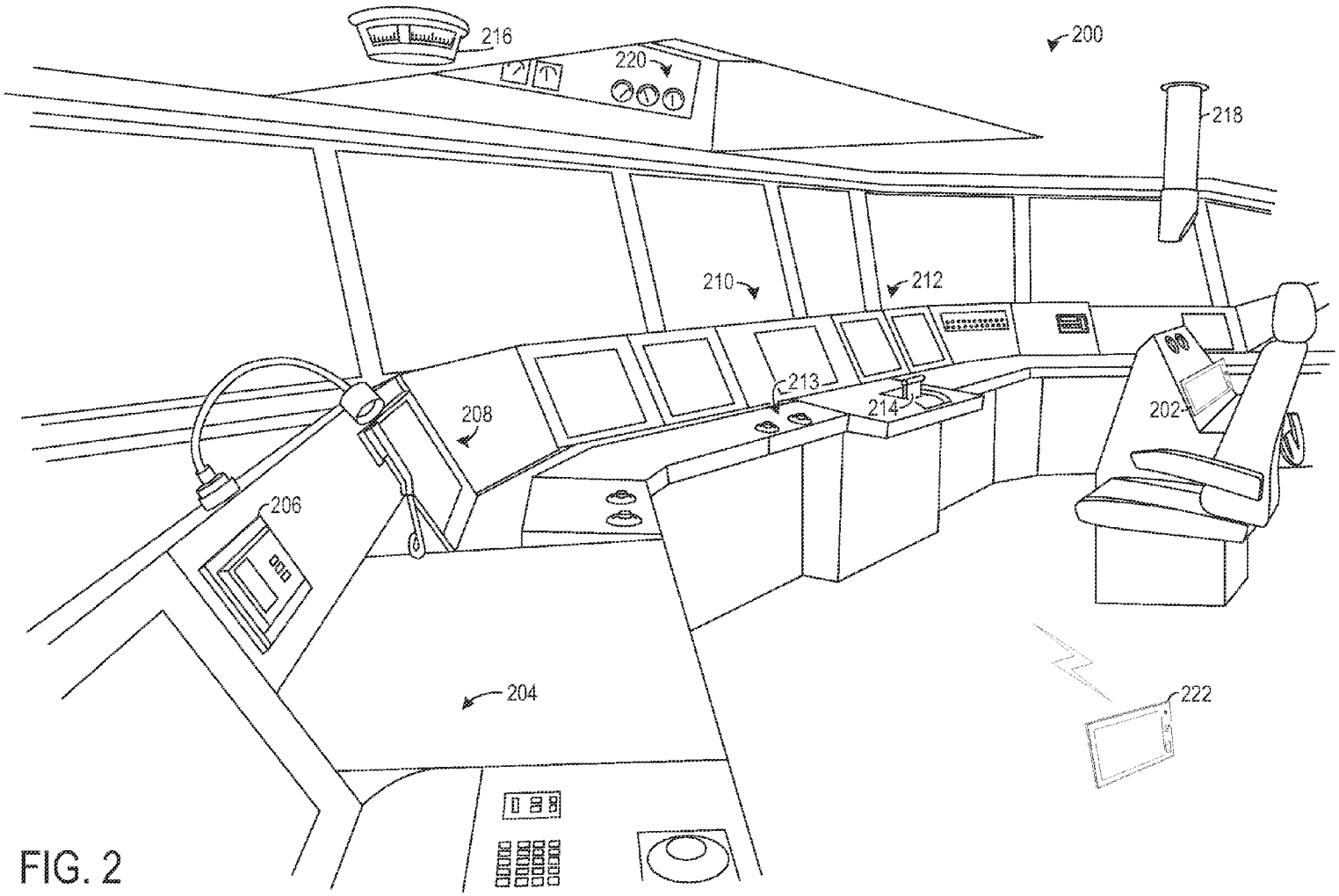
FIG. 2 shows an example use case scenario comprising another non-limiting example of a remote control device.

It will be appreciated that environment 100 is presented for the purpose of example, and that remote control device 120 may be configured to communicate with a variety of marine electronics devices in a variety of marine use environments. For example, turning now to FIG. 2, a second example use environment 200 comprising remote control device 202 is shown in the form of a bridge of a ship. In order to illustrate a few of the multitude of possible marine electronic devices with which remote control device 202 may interact, environment 200 further comprises fire-detection controller 204, GPS controller 206, VHF radio 208, ECDIS 210, and engine controller 212. Although some of the illustrated devices include mechanisms configured to receive user input (e.g., ECDIS 210 includes rotational knobs 213, engine controller 212 includes throttle 214, etc.), it will be appreciated that some marine electronics devices (e.g., sensor devices) may be configured to supply information without user input. As such, environment 200 comprises additional marine electronics devices in the form of rudder angle indicator 216 and compass 218 configured to provide a rudder angle and a magnetic bearing angle, respectively. It will be appreciated that the illustrated marine electronics devices are provided for the purpose of example and that remote control device 202 may be configured to interact with additional and/or different marine electronics devices 220 (e.g., anemometers, clinometers, tachometers, etc.) without departing from the scope of the present disclosure.

As mentioned above, it will be appreciated that a plurality of remote control devices may be usable within a given environment in order to effect control over the same and/or different marine electronics devices. Environment 200 is therefore further illustrated as including remote control device 222 in wireless communication with remote control device 202 and/or one or more of the marine electronics devices. Although illustrated in a similar manner as remote control device 202, it will be understood that remote control device 222 may have suitable configuration. Generally speaking, any configuration of one or more remote control devices and/or one or more marine electronics devices is possible without departing from the scope of the present disclosure.

Figure 3:
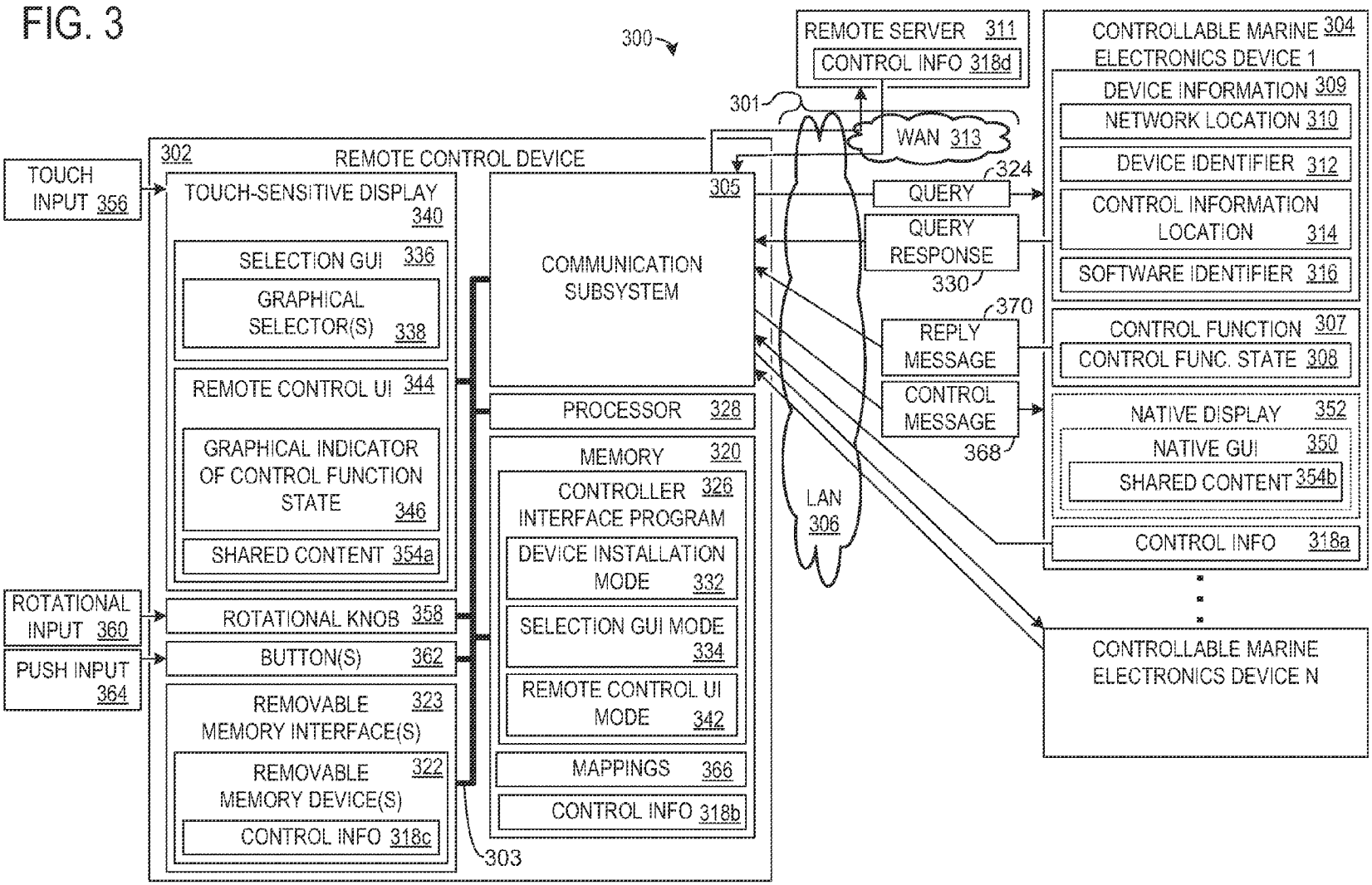
FIG. 3 schematically shows a non-limiting use environment comprising a remote control device in accordance with an embodiment of the present disclosure.

FIG. 3 schematically shows example use environment 300 comprising remote control device 302 in accordance with an embodiment of the present disclosure. The various components of remote control device 302, described below, may be configured to communicate via shared bus 303 comprising one or more discrete connections (e.g., one or more electrical and/or optical connections). Although a single bus is illustrated, it will be appreciated that remote control device 302 may include additional busses and/or other connection(s) (e.g., one or more wireless connections) in order to operatively couple the various components thereof.

Remote control device 302 may be configured to interact with one or more controllable marine electronics devices 304, illustrated as an arbitrary number n of controllable marine electronics devices, via communication subsystem 305. Although environment 300 comprises a single remote control device 302 in communication with a plurality of controllable marine electronics devices 304 for the ease of understanding, it will be appreciated that an environment may include any number and/or configuration of remote control devices 302 in communication with any number and/or configuration of controllable marine electronics devices 304. For example, in some environments (e.g., environment 200), two or more remote control devices (e.g., remote control devices 202 and 222) may be operatively coupled to effect control over the one or more controllable marine electronics devices. In some embodiments, each remote control device may control an equivalent set of controllable marine electronics devices, whereas each remote control device may control a different set of controllable marine electronics devices in other embodiments. In some embodiments, one or more remote control devices may be configured to effect control over one or more other remote control devices. It will be appreciated that these scenarios are presented for the purpose of example, and are not intended to be limiting in any manner.

Communication subsystem 305 may be operatively coupled to the controllable marine electronics device via a computer network 301. The computer network 301 may include a Local Area Network ("LAN") 306 to which the controllable marine electronics devices are connected, and the communication subsystem 305 may be configured to communicate with each of the controllable marine electronics devices across the LAN 306. For example, communication subsystem 305 may include one or more wired and/or wireless network interface controllers ("NICs") to provide unidirectional and/or bi-directional communication via the network. While LAN 306 is illustrated as a single network, it will be appreciated that remote control device 302 may be configured to interact with any one or more controllable marine electronics devices 304 via any one or more networks without departing from the scope of the present disclosure. Furthermore, in some embodiments, LAN 306 may include one or more devices, such as hubs, routers, access points, etc. (not illustrated) to which one or more devices (e.g., remote control device 302, controllable marine electronics devices 304, etc.) are operatively coupled. For example, remote control device 302 may be configured to interact with a first set of controllable marine electronics devices via a first wired network (e.g., NMEA 2000 network), with a second set of controllable marine electronics devices via a second wired network (e.g., 802.3 network), and with a third set of controllable marine electronics devices via a wireless network (e.g., 802.11 network including one or more wireless "access points").

In some embodiments, computer network 301 may further include a Wide Area Network ("WAN") 313 accessible via a WAN gateway of LAN 306, and communication subsystem 305 may be operatively coupled to and configured to communicate with one or more remote servers 311 via WAN 313. WAN 313 may be, for example, the Internet. It will be appreciated that the configurations of computer network 301 are presented for the purpose of example, and are not intended to be limiting in any manner.

As mentioned above, not all marine electronics devices operatively coupled to LAN 306 may be remotely-controllable, (e.g., due to proprietary protocols, proprietary physical interfaces, lack of network interface, etc.). As such, the term "controllable marine electronics device" will be used herein to refer to any marine electronics device operable via a remote control device. For example, in other embodiments, environment 300 may include one or marine electronics devices, which may or may not be operatively coupled to LAN 306 and/or to other networks such as WAN 313, which are not controllable marine electronics devices.

Regardless of the specific configuration, each controllable marine electronics device 304 includes one or more control functions 307. In some embodiments, one or more control functions 307 may be configured to modify one or more control parameters (e.g., device settings, etc.). In other embodiments, the one or more control functions may be configured to provide other control (e.g., GUI manipulation, etc.). As used herein, the term "control function" refers to an element (e.g., graphical user interface element, input mechanism, setting, preference, etc.) of a controllable marine electronics device that is controllable by a remote control device.

As one non-limiting example, control functions 307 for a "depth finder" (e.g., SONAR) may include gain adjustments, frequency adjustments, transmission power adjustments, readout background/foreground color, etc. As another non-limiting example, control functions 307 for a radar-based marine electronics device may include antenna rotation speed, antenna heading alignment, sector blanking enable/disable, bearing scale mode, echo color, etc. It will be appreciated that these control functions are presented for the purpose of example and that any controllable marine electronics device may include any number and configuration of control functions 307 without departing from the scope of the present disclosure. Other example control functions will be discussed in greater detail below with reference to FIGS. 4A, 4B, and 4C.

In order to elucidate the configuration of the one or more controllable marine electronics device 304 (e.g., identify one or more control functions 307, identify a software type/version, identify a model/serial number, etc.), each of the controllable marine electronics devices may be configured to provide device information 309 to remote control device 302, via a query and response protocol described below. The device information may include, but is not limited to, one or more of network location 310 of the controllable marine electronics device (e.g. URL, "hostname," or other network location identifier), device identifier 312 (e.g., manufacturer, model, device "type," serial number, etc.), location 314 (e.g., URL or other location identifier) of control information 318, and controllable device software identifier 316 (e.g., software "version," whether or not the control information is available from the controllable marine electronics device, etc.).

Upon receiving this device information with the location 314 of the control information, the controllable marine electronics device is configured to acquire the control information for the controllable marine electronics device from the location 314. As used herein, the term "control information" refers to information (e.g., command interfacing/translating software, command lists, GUIs, etc.) usable by the remote control device to effect control over the controllable marine electronics device(s). It will be appreciated that the control information may be available at, and/or acquired from, various locations within environment 300, as will be discussed in greater detail below. For example, in some embodiments, control information 318 may include one or more of control information 318*a* provided by controllable marine electronics device 304, control information 318*b* stored in memory 320 of remote control device 302, and control information 318*c* stored via one or more removable memory devices 322 coupled to remote control device 302. Removable memory devices 322 may include, for example, Secure Digital "SD" cards, USB memory sticks, and/or other removable memory devices. Remote control device 302 may therefore include one or more removable memory interfaces 323 (e.g., USB ports, memory card sockets, etc.) to provide access to removable memory devices 322 by various components of remote control device 302. For example, in one non-limiting embodiment, remote control device 302 may include two front-facing removable memory slots in order to provide control information 318*c* and/or other information (e.g., updated maps/charts, personal files, etc.) to remote control device 302.

In some embodiments, control information 318 may include control information 318*d* provided by remote computing device 311. For example, remote computing device 311 may be a manufacturer-specific server configured to provide control information 318*d* for controllable marine electronics devices 304 created by the manufacturer. As another example, remote computing device 311 may be a server comprising control information 318*d* for a variety of controllable marine electronics devices.

Regardless of the specific configuration, it will be appreciated that remote control device 302 may be configured, upon receiving device information 309 for a particular marine electronics device 304, to acquire control information 318 corresponding to the controllable marine electronics device. For example, the remote control device may be configured to receive the control information from location 314 identified by the device information. It will be appreciated that such scenarios are presented for purpose of example, and that the control information may be available at, and/or acquired from, any suitable remote and/or local location(s) (e.g., remote locations accessible via the Internet) without departing from the scope of the present disclosure.

It will be further appreciated that the control information may be received from, identified by, and/or otherwise made available from, any one or more locations according to any suitable mechanism(s). For example, in some embodiments, controller interface program 326 of remote control device 302 may be configured to provide query 324 to one or more marine electronics devices. Controller interface program 326 may be embodied in, for example, one or more instructions stored via memory 320 and executable via processor 328. In other embodiments, the controller interface program may be embodied in another combination of software and/or hardware without departing from the scope of the present disclosure (e.g., application-specific integrated circuit ("ASIC"), programmable logic device ("PLD"), etc.).

Turning now to the query response protocol for obtaining the device information, query 324 may be sent to a subset of the marine electronics devices operatively coupled (e.g., via network 306) to remote control device 302 and/or may be sent to every marine electronics device. In response to the query, each controllable marine electronics device 304 may be configured to provide query response 330 comprising device information 309 and/or other suitable information to the remote control device(s). As mentioned above, one or more marine electronics devices operatively coupled to network 306 may not be controllable via the remote control device(s), and may therefore not be configured to provide query response 330. In other embodiments, one or more "non-controllable" marine electronics devices may be configured to provide query response 330 containing information that alerts the remote control device of such non-controllability. Query 324 may be periodically provided (e.g., upon remote control device initialization, upon detection of a new marine electronics device, with regular and/or irregular frequency, etc.) in order to receive up-to-date device information 309 from each controllable marine electronics device 304. In other embodiments, one or more marine electronics devices 304 may be configured to provide query response 330 without first receiving query 324 (e.g., programmatically provided upon initialization of the marine electronics device(s), upon detection of remote control device 302 on a network by the marine electronics device, etc.).

If a particular controllable marine electronics device 304 is not presently controllable via remote control device 302, controller interface program 326 may be configured to provide device installation mode 332. The device installation mode may include, for example, "installing" control information 318 onto remote control device 302. In some scenarios, control information 318*a*, 318*c* and/or 318*d* may include newer information than previously-installed control information 318*b*. In some embodiments, user(s) of remote control device 302 may be alerted to available "upgrades," and such upgrading occur when a user confirmation is received. In other embodiments, the upgrading may be programmatically provided without depending upon user authorization. In yet other embodiments, each instance of control information 318 may be updated upon recognition of an updated version at any of one or more locations. For example, upon recognizing updated control information 318*c* (i.e., control information present on a removable memory device 322), both control information 318*b* (i.e., "local" copy of remote control device 302) and 318*a* (i.e., control information stored by the controllable marine electronics device) may be updated.

Figure 4A:
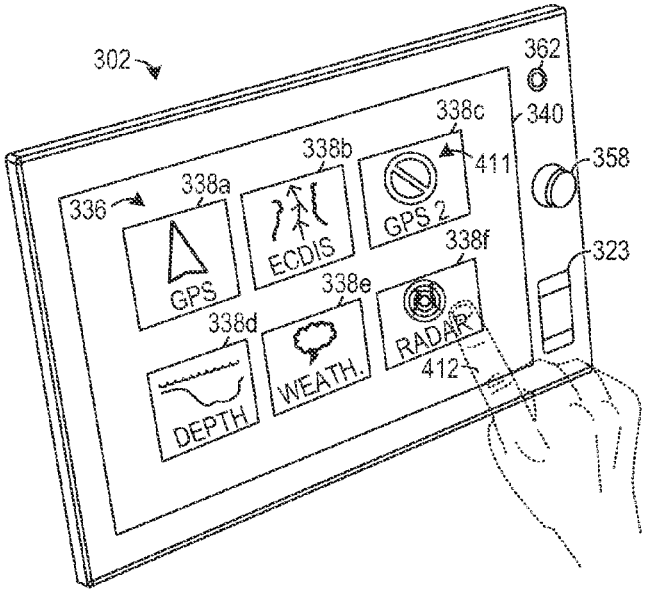
FIGS. 4A, 4B, and 4C show non-limiting examples of a graphical user interface of a remote control device in accordance with an embodiment of the present disclosure.

Controller interface program 326 may be further configured to provide selection GUI mode 334 by outputting selection GUI 336 (e.g., "home screen") comprising one or more graphical selectors 338 (e.g., "icons") via touch-sensitive display 340. For example, FIG. 4A shows an example selection GUI 336 provided by display 340 of an example embodiment of a remote control device 302. Remote control device 302 further includes button 362, rotational knob 358, and removable memory interfaces 323 (e.g., one or more removable memory slots). Such a configuration is presented for the purpose of example, and is not intended to be limiting in any manner.

GUI 336 includes a plurality of graphical selectors 338 (i.e., "GPS" 338*a*, "ECDIS" 338*b*, "GPS 2" 338*c*, "DEPTH" 338*d* (e.g., SONAR-based device), and "WEATH" 338*e* (e.g., weather-monitoring device), and "RADAR" 338*f*) each representing a controllable marine electronics device. As illustrated by the example graphical selector 338*c*, one or more of the displayed graphical selectors may be disabled, and may indicate (e.g., via a "No" symbol 411) that a corresponding previously-configured marine electronics device (e.g., device for which device installation mode 332 was previously, and/or is currently being, provided) is not currently controllable (e.g., during initialization, during loss of network connectivity, etc.). In other embodiments, the remote control device may be configured to not display such disabled graphical selectors and/or may be configured to provide additional and/or different representations thereof. Selection (e.g., via finger 412) of an "enabled" graphical selector may effect presentation of mechanism(s) (e.g., GUI) for controlling the corresponding controllable marine electronics device. In some embodiments, selection of a disabled graphical selector may effect presentation of a configuration mechanism (e.g., controllable marine electronics device "settings" GUI) in order to resolve connectivity issues and/or to otherwise configure the marine electronics device. In other embodiments, GUI 336 may include one or more graphical selectors 338 that do not correspond to a controllable marine electronics device and instead correspond to one or more mechanisms of remote control device 302 (e.g., remote control device "settings" GUI).

Returning to FIG. 3, controller interface program 326 is further configured to provide remote control user interface mode 342 comprising remote control UI 344 via touch-sensitive display 340. Remote control UI 344 may include one or more graphical indicators 346 identifying a particular control function state 308. For example, turning briefly to FIG. 4B, remote control device 302 is shown presenting remote control UI 344 (i.e., "RADAR" remote control UI corresponding to selection of graphical selector 338*f* of FIG. 4A).

Remote control UI 344 includes a plurality of graphical indicators 346, including highlight 346*a* (illustrated by a dashed outline), slider 346*b*, and numerical value 346*c*, each identifying a corresponding control function state 308 of control functions 307*a* (i.e., auto-tuning enable), 307*b* (i.e., start angle), and 307*c* (i.e., antenna heading align), respectively. Graphical indicator 346*a* indicates the corresponding binary state (e.g., "ON" or "OFF") of control function 307*a*; graphical indicator 346*b* includes a "slider" indicating the control function state of control function 307*b* and configured to receive user-input within a pre-defined range (e.g., "0" degrees to "360" degrees) for manipulation of the control state; and graphical indicator 346*c* includes a numerical value (e.g., 120°) indicating the control functions state of control function 307*c*.

As illustrated, when control function 307*c* is "mapped to" rotational knob 358, rotation of the rotational knob (e.g., via hand 414) may be configured to vary graphical indicator 346*c* and/or a corresponding control function state 308. In order to provide such functionality, rotational input 360 received via rotational knob 358 may effect provision of control message 368 to controllable marine electronics device 304 (e.g., via communication subsystem 305). Specifically, one or more mappings of mappings 366 may be utilized in order to provide a "scaled" representation of rotational input 360 such that the rotational input effects a desired change in the control function state. For example, 90 degrees of clockwise rotation of rotational knob 358 may increment the control function state corresponding to graphical indicator 346*c*, and thus the numerical information of graphical indicator 346*c*, by 1 degree. In other words, the rotational input (e.g., quarter-turn clockwise) may be mapped via mappings 366 in order to provide control message 368 including information usable by the controllable marine electronics device to increment the control function state of control function 307*c* by 1 degree. Since the updating of the control state is "local" to controllable marine electronics device 304, the controllable marine electronics device may be configured to provide reply message 370 to remote control device 302 so as to effect updating of a visual appearance of corresponding graphical indicator 346*c* to reflect the current state of the control function.

In other words, the target controllable marine electronics device of the illustrated example is a RADAR-based marine electronics device (e.g., RADAR antenna and/or input/output devices coupled thereto), the control function is an antenna heading alignment control function, and the rotational knob input is mapped to cause the control function to vary an antenna heading alignment control parameter (e.g., control function state 308 of control function 307*c*), and the graphical indication of the state (e.g., graphical indicator 346*c*) of the control function is a numerical value. In other embodiments, graphical indicator 346*c* may include an arrow (e.g., rotatable arrow overlaying shared content 354 including a radar image), or other visual representation, indicating the state of control function 307*c*. In yet other embodiments, remote control device 302 may be configured to provide one or more visual indicators (e.g., highlights, font formatting, etc.) indicating the control function(s) currently mapped to the rotational knob.

Figure 4B:
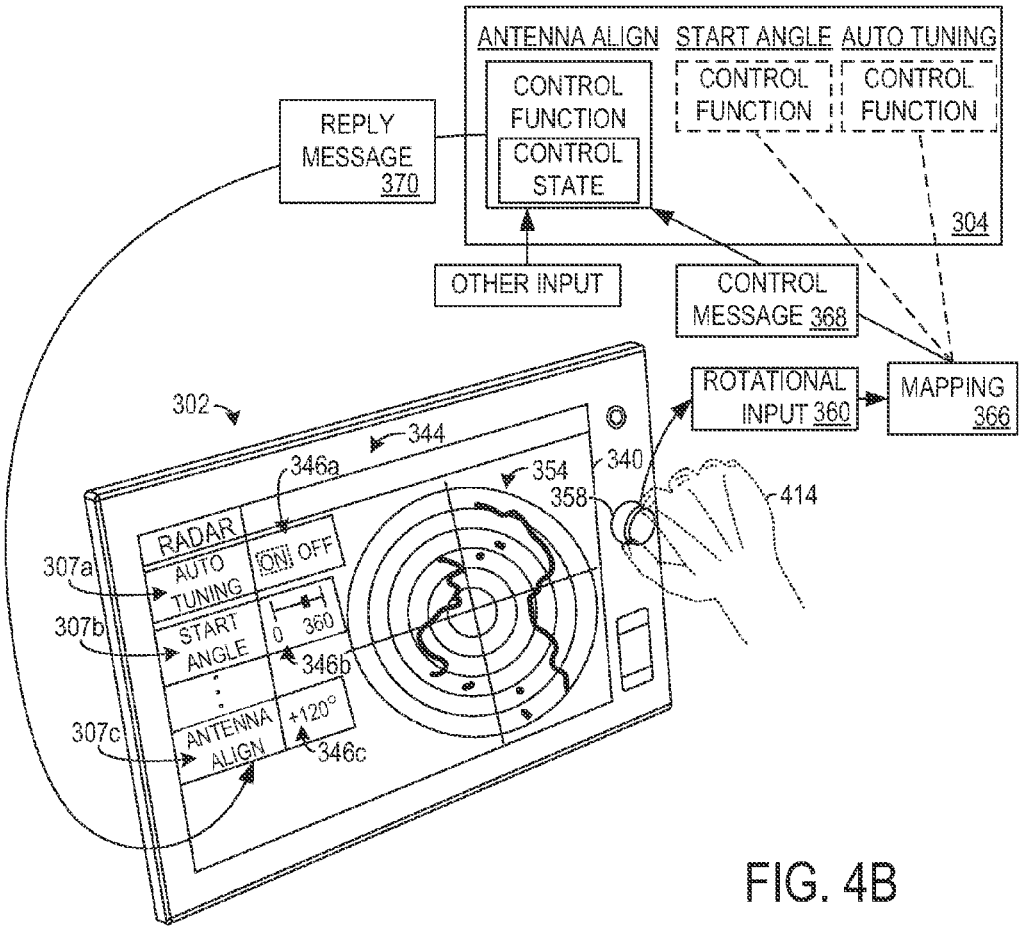

It will be appreciated that the RADAR-based scenario of FIG. 4B is provided for the purpose of example, and other marine electronics devices may be operable via a remote control device (e.g., remote control device 302). For example, in other embodiments, the remote control device may be configured to effect control over one or more control functions of an acoustic-based device (e.g., "depth finder," "fish finder," SONAR, etc.). In some use case scenarios, the rotational knob may be mapped to a transmission power of one or more acoustic transducers (e.g., transducer 108 of FIG. 1). In such scenarios, the target controllable marine electronics device is an acoustic-based marine electronics device, the control function is a transmission power control function, and the rotational knob input is mapped to cause the control function to vary a transmission power control parameter, and the graphical indication of the state of the control function is a slider.

Although FIG. 4B illustrates a visual representation of control functions 307 in the form of identifying text, one or more of the control functions may include a different representation, may include additional representation(s), and/or may include no representation in other embodiments. Furthermore, although manipulation of the control functions, and graphical indicators thereof, are presented via a menu system, it will be understood that these scenarios are presented for the purpose of example and that the GUI, control functions, and visual indicators may have any suitable configuration without departing from the scope of the disclosure.

Figure 4C:
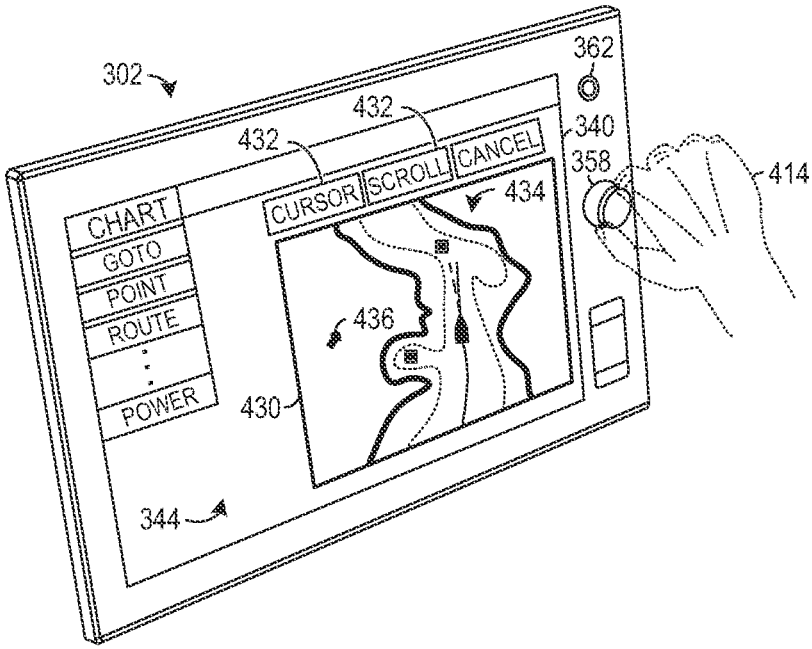

As yet another example, FIG. 4C shows an example remote control UI 344 for a "chart plotter" controllable marine electronics device. For example, the UI of FIG. 4C may be displayed upon selection of graphical selector 338*b* (i.e., "ECDIS"). The UI includes scroll/pan area 430 displaying an electronic chart. In some embodiments, scroll/pan area 430 may be manipulable via touch input 356 (e.g., via "dragging" view 434 of the scroll/pan area) to modify the view. In some embodiments, information presented via scroll/pan area 430 may include shared content 354. The UI further includes a plurality of software buttons 432 (e.g., touch-interactive interface elements), such as "CURSOR," and "SCROLL," each corresponding to a particular control function 307. In other words, manipulation of a particular control function state 308 may be effected via touch input 356 received at touch-sensitive display 340 which is associated with a software button 432 corresponding to the control function. For example, touch input corresponding to "SCROLL" button 432 may effect up/down and/or left/right scrolling of the view of scroll/pan area 430.

Further, when control function 307 corresponding to "SCROLL" button 432 is mapped to the rotational knob, rotation of the rotational knob (e.g., via hand 414) may be configured to vary a corresponding graphical indicator 346 (e.g., view 434). For example, rotation of the rotational knob in the counter-clockwise direction may effect up/down scrolling of the view, and clockwise rotation may effect left/right scrolling of the view. In some embodiments, one of left/right and up/down scrolling may be active at a given time, and such functionality may be selected via push input 364 received via button 362, touch input 356 received via touch-sensitive display 340, and/or via other selection mechanism(s). As another example, when control function 307 corresponding to "CURSOR" button 432 is "mapped to" rotational knob 358, rotation of the rotational knob may be configured to vary a corresponding graphical indicator 346 (e.g., arrow cursor 436) and/or a corresponding control function state 308.

Returning to the example environment of FIG. 3, each controllable marine electronics device 304 may be configured to provide, independent of the remote control device(s), native GUI 350 via native display 352 (e.g., display device in shared housing, remote display device, etc.). In this way, it will be appreciated that the remote control device is not a "dumb" terminal at which to display information received form one or more controllable marine electronics devices 304, but is instead configured to effect control over the controllable marine electronics devices via mechanism(s) independent of the controllable marine electronics device.

In embodiments having such a configuration, at least a portion of the content displayed via remote control user interface 344 is shared content 354 (e.g., shared content 354*a*) that is also displayed on the native graphical user interface (e.g., shared content 354*b*). For example, briefly returning to the example of FIG. 4B, the shared content 354 may include a radar image that can also be displayed via a native display (e.g., displays 110 and/or 112). Although such shared content may be displayed via both a native display of the controllable marine electronics device and display 340 of remote control device 302, it will be appreciated that the shared content may include different representations at each display. For example, shared content 354 may include a color image when presented via display 340, whereas shared content 354 may include a grayscale image when presented via the native display. As another example, a "zoom level" of the shared content on display 340 may be higher than a "zoom level" of the shared content on the native display (e.g., to provide greater amount of detail via display 340).

Although output functionality (e.g., information display) has been discussed so far with reference to FIG. 3, it will be understood from the preceding discussion that it may desirable to effect control over the one or more controllable marine electronics devices 304 via remote control device 302. Accordingly, touch-sensitive display 340 may be configured to receive touch input (e.g., one or more multi-touch inputs). Touch-sensitive display 340 may utilize one or more mechanism(s) in order to provide such features, including, but not limited to, resistive touch sensors, capacitive touch sensors, computer imaging mechanisms (e.g., in projection-based systems), and the like. Regardless of the specific configuration, such touch recognition may not be desirable and/or practical in every use case scenario (e.g., when fingers are wet, in direct sunlight, etc.).

In scenarios where other input is desired, remote control device 302 may further comprise one or more rotational knobs 358 configured to receive rotational input 360. Rotational knob 358 may translate rotational input 360 into one or more representational signals via various mechanism(s), including, but not limited, optical rotary encoders, mechanical rotary encoders, magnetic rotary encoders, and the like. As many typical marine electronics devices (e.g., marine electronics devices 110, 210, etc.) include one or more rotational input mechanisms (e.g., rotational knobs 114 and 213, respectively), it will be appreciated that rotational knob 358 may provide a more satisfactory user experience by mimicking the user experience of the marine electronics device. Furthermore, rotational knob 358 may provide an intuitive interface for incrementing/decrementing values, navigating lists and/or menus, specifying rotation(s), and/or for receiving other user input.

Remote control device 302 may further comprise one or more buttons 362 configured to receive push input 364. Buttons 362 may translate push input 364 into one or more representational signals via various mechanism(s), including, but not limited to, mechanical sensors (e.g., tactile switch, membrane switch, etc.), optical sensors (e.g., optical encoder, optical break sensor, etc.), magnetic sensors (e.g., magnetic reed switch), and/or capacitive sensors. It will be appreciated that such input mechanisms are presented for the purpose of example and that remote control device 302 may comprise any combination of any one or more input mechanisms without departing from the scope of the present disclosure.

It will be further appreciated that, for any given controllable marine electronics device 304, the device may include a greater number of control functions 307 than remote control device 302 includes rotational knobs 358 and/or other input mechanisms (e.g., buttons 362). In other words, rotational knob 358 may be configured to effect control over a subset (e.g., one) of available control functions 307 at any given time. Accordingly, controller interface program 326 may further include mappings 366 identifying the one or more control functions 307 controllable by rotational input 360 recognized via rotational knob 358. In other words, mappings 366 may be configured such that rotational input 360 received when remote control user interface 344 is displayed (e.g., user interface provided by remote control UI mode 342 of controller interface program 326) is represented via control message 368 sent, via communication subsystem 305, to a target controllable marine electronics device (e.g., controllable marine electronics device 304) to control a control function of control functions 307 of the target controllable marine electronics device. As used herein, the term "target controllable marine electronics device" refers to any one or more controllable marine electronics devices 304 presently controllable (e.g., via mappings 366) by input mechanism(s) of remote control device 302 (e.g., rotational knob 358 and/or buttons 362). The mappings may be defined via control information 318 and/or may be user-defined.

It will be appreciated that manipulation of control function 307 according to rotational input 360 mapped by mappings 366 may effect a change in state 308 of the control function. Accordingly, remote control device 302 may be further configured to receive reply message 370 from the target controllable marine electronics device configured to effect updating of a visual appearance of a corresponding graphical indicator 346 to reflect the current state of the control function. When remote control UI 344 is not displayed (e.g., during display of selection GUI 336), rotational input 360 may not effect transmission of control message 368, and may instead effect control over remote control device 302 (e.g., selection GUI 336).

In some embodiments, manipulation of a particular control function 307 of a particular controllable marine electronics device 304 may also effect manipulation of one or more additional control functions of one or more other controllable marine electronics devices. For example, updating of date/time at a GPS controller (e.g., device 110 and/or 112) may effect similar updating (e.g., "synchronizing") of a GPS receiver (e.g., device 106) and/or other controllable marine electronics devices. Accordingly, it will be appreciated that reply message 370, and/or one or more control messages 368 sent in response by remote control device 302, may be provided to the controllable marine electronics devices in order to provide such synchronicity.

It will be appreciated that the configuration of remote control device 302 is intended to be non-limiting, and a remote control device may include additional and/or different components without departing from the scope of the present disclosure. For example, in other embodiments, remote control device 302 may further include a power subsystem (e.g., one or more batteries, external power connectors, etc.) configured to provide "tethered" and/or mobile device operation. Such a subsystem may be configured to charge one or more batteries upon connection (e.g., "docking") of the remote control device to a "base station," and thus to provide stored power when the device is removed from the base station. Accordingly, in such embodiments, the remote control device may be usable in various locations, which may desirable in particular use case scenarios (e.g., while a user traverses environment 200).

Figure 5:
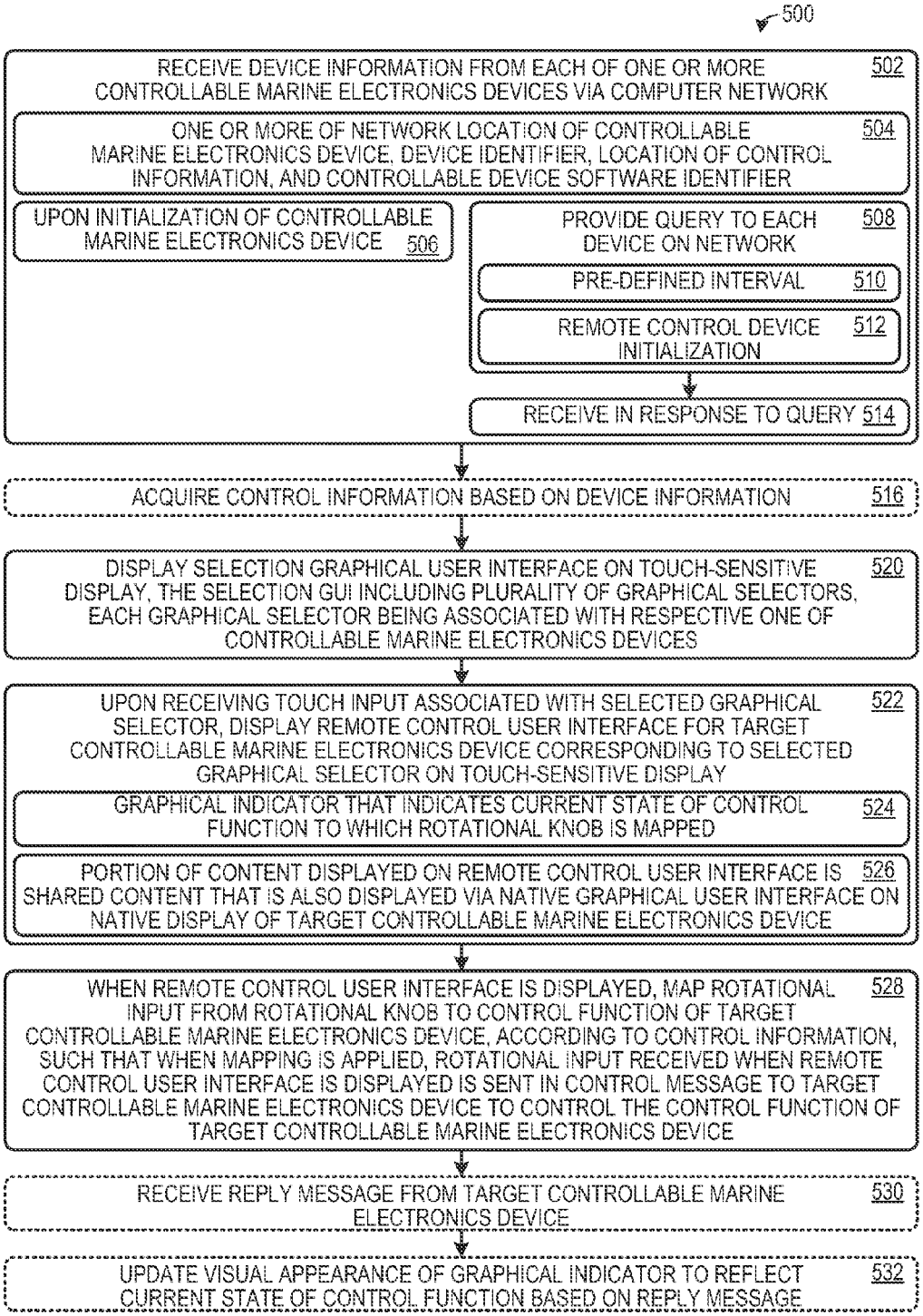
FIG. 5 shows a process flow depicting an embodiment of a method for operating a remote control device.

Turning now to FIG. 5, a process flow depicting an embodiment of a method for operating a remote control device (e.g., remote control device 302) is shown. Method 500 comprises, at 502, receiving device information from each of the one or more controllable marine electronics devices via a computer network. The device information may include one or more of a network location of the controllable marine electronics device, a device identifier, a location of control information, and a controllable device software identifier, as shown at 504. It will be understood that in some embodiments, the device information may comprise additional and/or different information without departing from the scope the present disclosure.

The device information may be received at any time and/or according to any suitable triggers. For example, in some embodiments, the device information may be received 506 from each of the one or more controllable marine electronics devices upon initialization of the controllable marine electronics device. In other words, each controllable marine electronics device may be configured to programmatically provide the device information upon initialization. As mentioned above, some marine electronics devices that are not remotely-controllable may be configured to provide information (e.g., device information) alerting the remote control device of a non-controllable configuration. In other embodiments, the non-controllable marine electronics devices may not be configured to provide any such information.

In other embodiments, instead of, and/or in addition to, receiving the device information upon initialization of each controllable marine electronics device, receiving the device information may include providing 508 a query to each device on the network. The query may be provided, for example, at a pre-defined interval 510 (e.g., every 5 minutes), upon initialization 512 of the remote control device, and/or at any other time(s). In response to the query, the device information may be received 514 from each of the one or more controllable marine electronics devices.

As mentioned above, the device information received from each controllable marine electronics device may include location(s) at which control information usable by the remote control device to effect control over any one or more control functions of the corresponding controllable marine electronics device(s) may be acquired. In some embodiments (e.g., control information locally stored by the controllable marine electronics device), the device information may include location information indicating local storage of the control information 318*a* for the controllable marine electronics device. In response to receiving this device information, the remote control device may be configured to directly query the controllable marine electronics device for the control information 318*a* at the specified location, and in response receive a transmission thereof.

However, in other embodiments (e.g., software update scenarios, etc.), the control information may be received independently of the device information and/or from location(s) other than the controllable marine electronic device. Accordingly, in such embodiments, method 500 may further comprise acquiring 516 the control information based on the device information (e.g., based on a network location provided by the device information, etc.). In other words, upon receiving the device information, the control information may be acquired according to a location of the control information provided in the device information. The network location may include, for example, one or more of the controllable marine electronics device, the persistent memory of the remote control device, a removable memory device of the remote control device, and a remote computing device operatively coupled to the remote control device via the computer network. It will be appreciated that the control information may be acquired via any suitable connection(s) (e.g., wired/wireless network, near-field communication, etc.) and according to any suitable protocol(s) (e.g., TCP/IP, NMEA 2000, CAN, etc.) without departing from the scope of the present disclosure.

Regardless of the specific configuration, it will be appreciated from the preceding discussion that the remote control device may be configured to "identify the environment" such that the remote control device may be able to interact with any one or more marine electronics devices present in, and/or introduced into, the environment.

Method 500 further comprise, at 520, displaying a selection graphical user interface (GUI) on the touch-sensitive display (e.g., GUI 336), the selection GUI including a plurality of graphical selectors (e.g., graphical selectors 338) each associated with a respective one of the controllable marine electronics devices.

At 522, method 500 further comprises, upon receiving touch input associated with a selected graphical selector, display a remote control user interface for a target controllable marine electronics device corresponding to the selected graphical selector on the touch sensitive display. For example, referencing the example of FIG. 4B, selection of graphical selector 338*f* (i.e., "RADAR") may effect display of a corresponding remote control UI 344 including shared content 354 (e.g., radar image). In other embodiments, the graphical selector may be selectable via additional and/or different mechanisms (e.g., rotational knob).

As briefly mentioned above, the remote control user interface may include a graphical indicator 524 that indicates a current state of the control function to which the rotational knob is mapped. Further, as some controllable marine electronics devices may include a native graphical user interface and/or a native display for display thereof, the user interface may further include shared content 526 that is also displayed on the native graphical user interface.

For example, returning briefly to the example of FIG. 4B, graphical indicator 346 indicates a current state (e.g., state 308) of the control function to which the rotational knob is mapped (e.g., control function 307). As mentioned above, the representation (e.g., numerals) of indicator 346*c* is presented for the purpose of example, and it will therefore be appreciated that the one or more graphical indicators may have any suitable configuration (e.g., numerals, text, graphics, colors, etc.) without departing from the scope of the present disclosure. Further, although remote control UI 344 further comprises shared content 354 including a radar image, it will be appreciated that such content is presented for the purpose of example, and is not intended to be limiting in any manner.

Method 500 further comprises, when the remote control user interface is displayed, mapping 528 the rotational input from the rotational knob to a control function of the target controllable marine electronics device according to the control information such that when the mapping is applied, the rotational input received when the remote control user interface is displayed is sent in a control message (e.g., control message 368) over a computer network 301 via a communication subsystem (e.g., via communication subsystem 305) to the target controllable marine electronics device to control the control function of the target controllable marine electronics device. The control information may include suitable information to effect such control.

As one non-limiting example, returning to the example of FIG. 4B, manipulation of rotational knob 358 (e.g., via hand 414) may be configured to modify the control function state of control function 307*c*. Specifically, 90 degrees of clock-wise rotation of the rotational knob may increment the control function state (e.g., increment to 121°). It will be appreciated that such modification is presented for the purpose of example, and that the control function state may be modified in any suitable manner (e.g., value increment/decrement, graphical element movement/manipulation, etc.) without departing from the scope of the present disclosure.

As such modification may effect corresponding modification to the associated graphical indicator(s), method 500 may further comprise receiving 530 a reply message from the target controllable marine electronics device and updating 532 a visual appearance of the graphical indicator to reflect the current state of the control function based on the reply message. The reply message may include, for example, image data, value data, and or any other suitable data that effects such an update.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

The invention claimed is:

1. A remote control device for use with marine electronics devices, the remote control device comprising:

a touch-sensitive display configured to display graphical images, and to receive touch input from a user;

a communication subsystem configured to provide bidirectional communication with one or more controllable marine electronics devices via a computer network;

processing hardware and persistent memory including instructions executable by the processing hardware to cause the processing hardware to:

receive device information from each of the one or more controllable marine electronics devices via the computer network;

for each controllable marine electronics device for which device information is received, receive respective control information from a corresponding location determined based on the device information received for the respective controllable marine electronics device;

display a selection graphical user interface (GUI) on the touch-sensitive display, the selection GUI including a plurality of graphical selectors, each graphical selector being associated with a respective one of the controllable marine electronics devices;

upon receiving touch input associated with a selected graphical selector, display a remote control user interface for a target controllable marine electronics device corresponding to the selected graphical selector on the touch sensitive display;

receive a message from the target controllable marine electronics device; and update a visual appearance of the remote control user interface based on the message from the target controllable marine electronics device.

2. A remote control device for use with marine electronics devices, the remote control device comprising:

a touch-sensitive display configured to display graphical images, and to receive touch input from a user;

a communication subsystem configured to provide bidirectional communication with one or more controllable marine electronics devices via a computer network;

a rotational knob configured to receive a rotational input from the user;

processing hardware and persistent memory including instructions executable by the processing hardware to cause the processing hardware to:

receive device information from each of the one or more controllable marine electronics devices via the computer network;

for each controllable marine electronics device for which device information is received, receive respective control information from a corresponding location determined based on the device information received for the respective controllable marine electronics device;

display a selection graphical user interface (GUI) on the touch-sensitive display, the selection GUI including a plurality of graphical selectors, each graphical selector being associated with a respective one of the controllable marine electronics devices;

upon receiving touch input associated with a selected graphical selector, display a remote control user interface for a target controllable marine electronics device corresponding to the selected graphical selector on the touch sensitive display; and when the remote control user interface is displayed, map the rotational input from the rotational knob to a control function of the target controllable marine electronics device according to the control information such that when the mapping is applied, the rotational input received when the remote control user interface is displayed is sent in a control message over the computer network via the communication subsystem to the target controllable marine electronics device to control the control function of the target controllable marine electronics device.

3. The remote control device of claim 2, wherein the remote control user interface includes a graphical indicator that indicates a current state of the control function to which the rotational knob is mapped; and wherein the instructions are further executable by the processing hardware to cause the processing hardware to receive a reply message from the target controllable marine electronics device, the reply message containing data that causes the processor hardware to update the visual appearance of the graphical indicator to reflect the current state of the control function.

4. The remote control device of claim 1, wherein the target controllable marine electronics device does not include a native graphical user interface or native display.

5. The remote control device of claim 1, wherein the target controllable marine electronics device includes a native display, with a native graphical user interface displayed thereon, which is independent from the remote control device.

6. The remote control device of claim 4, wherein at least a portion of the content displayed on the remote control user interface is shared content that is also displayed on the native graphical user interface.

7. The remote control device of claim 1, wherein the device information comprises one or more of a network location of the controllable marine electronics device, a device identifier, a location of the control information, and a controllable device software identifier;

wherein the location of the control information includes one or more of the controllable marine electronics device, the persistent memory of the remote control device, a removable memory device of the remote control device, and a remote server accessible via a wide area network of the computer network; and wherein receiving the control information occurs in response to sending a request for the control information to the marine electronics device or to the remote server from the remote control device to retrieve the control information at the location.

8. The remote control device of claim 1, wherein the instructions are further executable to provide a query to each device on the network, wherein the device information is received from each of the one or more controllable marine electronics devices in response to the query.

9. The remote control device of claim 7, wherein providing the query to each controllable marine electronics device on the network occurs at one or more of initialization of the remote control device and a predefined interval.

10. The remote control device of claim 1, wherein the device information is received from each of the one or more controllable marine electronics devices upon initialization of the controllable marine electronics device.

11. The remote control device of claim 2, wherein the target controllable marine electronics device is a RADAR-based marine electronics device, the control function is an antenna heading alignment control function, and the rotational knob input is mapped to cause the control function to vary an antenna heading alignment control parameter, and where the graphical indication of the state of the control function is a numerical value.

12. The remote control device of claim 2, wherein the target controllable marine electronics device is an acoustic-based marine electronics device, the control function is a transmission power control function, and the rotational knob input is mapped to cause the control function to vary a transmission power control parameter, and where the graphical indication of the state of the control function is a slider.

13. On a remote control device comprising a touch-sensitive display, a method of controlling one or more controllable marine electronics devices, the method comprising:

receiving device information from each of one or more controllable marine electronics devices via a computer network;

for each controllable marine electronics device for which device information is received, receive respective control information from a corresponding location determined based on the device information received for the respective controllable marine electronics device;

displaying a selection graphical user interface (GUI) on the touch-sensitive display, the selection GUI including a plurality of graphical selectors, each graphical selector being associated with a respective one of the controllable marine electronics devices;

upon receiving touch input associated with a selected graphical selector, displaying a remote control user interface for a target controllable marine electronics device corresponding to the selected graphical selector on the touch-sensitive display receiving a message from the target controllable marine electronics device; and updating a visual appearance of the remote control user interface based on the message from the target controllable marine electronics device.

14. On a remote control device comprising a touch-sensitive display and a rotational knob, a method of controlling one or more controllable marine electronics devices, the method comprising:

receiving device information from each of one or more controllable marine electronics devices via a computer network;

for each controllable marine electronics device for which device information is received, receive respective control information from a corresponding location determined based on the device information received for the respective controllable marine electronics device;

displaying a selection graphical user interface (GUI) on the touch-sensitive display, the selection GUI including a plurality of graphical selectors, each graphical selector being associated with a respective one of the controllable marine electronics devices; and upon receiving touch input associated with a selected graphical selector, displaying a remote control user interface for a target controllable marine electronics device corresponding to the selected graphical selector on the touch-sensitive display; and when the remote control user interface is displayed, mapping the rotational input from the rotational knob to a control function of the target controllable marine electronics device, according to the control information, such that when the mapping is applied, the rotational input received when the remote control user interface is displayed is sent in a control message over the computer network to the target controllable marine electronics device to control the control function of the target controllable marine electronics device.

15. The method of claim 14, wherein the remote control user interface includes a graphical indicator that indicates a current state of the control function to which the rotational knob is mapped; and wherein the method further comprises:

receiving a reply message from the target controllable marine electronics device, and updating the visual appearance of the graphical indicator to reflect the current state of the control function based on the reply message.

16. The method of claim 13, wherein at least a portion of the content displayed on the remote control user interface is shared content that is also displayed via a native graphical user interface on a native display of the target controllable marine electronics device.

17. The method of claim 13, wherein the device information comprises one or more of a network location of the controllable marine electronics device, a device identifier, a location of the control information, and a controllable device software identifier;

wherein the location of the control information includes one or more of the controllable marine electronics device, the persistent memory of the remote control device, a removable memory device of the remote control device, and a remote server accessible via a wide area network of the computer network; and wherein receiving the control information occurs in response to sending a request for the control information to the marine electronics device or to the remote server from the remote control device to retrieve the control information at the location.

18. The method of claim 13, further comprising:

providing a query to each device on the network at one or more of initialization of the remote control device and a pre-defined interval, wherein the device information is received from each of the one or more controllable marine electronics devices in response to the query.

19. The remote control device of claim 13, wherein the device information is received from each of the one or more controllable marine electronics devices upon initialization of the controllable marine electronics device.

20. A remote control device for use with marine electronics devices, the remote control device comprising:

a touch-sensitive display configured to display graphical images, and to receive touch input from a user;

a rotational knob configured to receive a rotational input from the user;

a communication subsystem configured to provide bidirectional communication with one or more controllable marine electronics devices via a computer network;

processing hardware and persistent memory including instructions executable by the processing hardware to cause the processing hardware to:

receive device information from each of the one or more controllable marine electronics devices via the computer network, the device information comprising one or more of a network location of the controllable marine electronics device, a device identifier, control information, a location of the control information, and a controllable device software identifier;

acquire the control information based on the device information;

display a selection graphical user interface (GUI) on the touch-sensitive display, the selection GUI including a plurality of graphical selectors, each graphical selector being associated with a respective one of the controllable marine electronics devices;

upon receiving touch input associated with a selected graphical selector, display a remote control user interface for a target controllable marine electronics device corresponding to the selected graphical selector on the touch sensitive display;

when the remote control user interface is displayed, map the rotational input from the rotational knob to a control function of the target controllable marine electronics device, according to the control information, such that when the mapping is applied, the rotational input received when the remote control user interface is displayed is sent in a control message over the computer network via the communication subsystem to the target controllable marine electronics device to control the control function of the target controllable marine electronics device, wherein the remote control user interface includes a graphical indicator that indicates a current state of the control function to which the rotational knob is mapped;

receive a reply message from the target controllable marine electronics device; and update, based on the reply message, the visual appearance of the graphical indicator to reflect the current state of the control function.

* * * * *